US006772853B2

(12) United States Patent
Yang

(10) Patent No.: US 6,772,853 B2
(45) Date of Patent: Aug. 10, 2004

(54) CLIP-ON EARPHONE DEVICE

(75) Inventor: Chin-Nian Yang, Taipei (TW)

(73) Assignee: Data-Fountain International Co., Jung Li (TW)

( * ) Notice: Subject to any disclaimer, the term of this patent is extended or adjusted under 35 U.S.C. 154(b) by 0 days.

(21) Appl. No.: 10/342,288

(22) Filed: Jan. 15, 2003

(65) Prior Publication Data

US 2004/0134710 A1 Jul. 15, 2004

(51) Int. Cl.[7] ..... H04R 25/00
(52) U.S. Cl. ..... 181/129; 381/370; 381/376; 381/379
(58) Field of Search ..... 381/381, 379, 381/322, 374, 370; 181/129

(56) References Cited

U.S. PATENT DOCUMENTS 5,117,464 A * 5/1992 Jones et al. ..... 381/379
6,427,018 B1 * 7/2002 Keliiliki ..... 381/381

* cited by examiner

*Primary Examiner*—Shih-Yung Hsieh
(74) *Attorney, Agent, or Firm*—Troxell Law Office PLLC

(57) ABSTRACT

An earphone device having a clip-on member coupled to a connecting base via a resilient repositioning mechanism, wherein a chute is disposed at the bottom of the connecting base; a connecting member having a sliding element coupled to the chute such that the sliding element slides in the chute; and an earphone coupled to the connecting member via a positioning mechanism such that the earphone rotates in an angle range.

9 Claims, 6 Drawing Sheets

CLIP-ON EARPHONE DEVICE

BACKGROUND OF THE INVENTION

1. Field of the Invention

The present invention generally relates to a clip-on earphone device and, more particularly, to a clip-on earphone device having a structure for a clip-on earphone, in which the position of the earphone can be adjusted and the earphone can rotate within a limited angle range in accordance with the face profiles of the users.

2. Description of the Prior Art

Recently, electronics technology has known a rapid and a spectacular development leading to an availability of more inexpensive electronic products to consumers. For example, earphones are increasingly utilized and improved, with the development of portable acoustic appliances, from headphones, earplug earphones to clip-on earphones. Particularly, clip-on earphone devices have become more and more popular and a great variety of such devices have been developed. A clip-on earphone device has a clip-on structure such that the clip-on earphone device can be fixed on the ears. However, every user is different in their head shapes, the face profiles and even the ear shapes. Free adjustment of the earphone position of the conventional clip-on earphone device is not available, and therefore it is usual that the user finds his purchase does not match with his/her face profile. As a result, the sound quality is not as expected and the user may feel uncomfortable. On the other hand, the clip-on earphone device makes people who wear glasses inconvenient and uncomfortable. Moreover, the conventional clip-on earphone device is not removable to be attached to the framework for a headphone. In this aspect, it is not flexible.

Taiwan Patent Publication No. 474541 entitled "Improved clip-on earphone/microphone" discloses a prior art, as shown in FIG. 1. In FIG. 1, a clip-on earphone device comprises a clip-on member A and an earphone B. On one end of the clip-on member A, a spherical member C with a T-shaped trench D is provided. Moreover, a hollow jacket E is provided oil the earphone B and a tenon F is provided inside the hollow jacket E. Therefore, the earphone B can be adjusted around the spherical member C as an axle center. However, the adjustment is limited and the earphone B is not removable, which causes trouble and inconvenience to the user.

Accordingly, there is need in providing a clip-on earphone device, in which the position of the earphone can be adjusted and the earphone can rotate within a limited angle range in accordance with the face profiles of the users.

SUMMARY OF THE INVENTION

In view of the aforementioned issue, it is the primary object of the present invention to provide a clip-on earphone device, in which the position of the earphone can be adjusted and the earphone can rotate within a limited angle range in accordance with the face profiles of the users.

It is another object of the present invention to provide a clip-on earphone device, in which the earphone is removable so as to be attached to the framework for a headphone, making the application easy and flexible.

To achieve the foregoing objects, the present invention provides a clip-on earphone, comprising: a clip-on member, coupled to a connecting base having a door via a resilient repositioning mechanism, wherein a chute is disposed at the bottom of said connecting base; a connecting member, having a sliding element coupled to said chute such that said sliding element slides in said chute; and an earphone, coupled to said connecting member via a positioning mechanism such that said earphone rotates in a limited angle range.

BRIEF DESCRIPTION OF THE DRAWINGS

The objects, spirits and advantages of the preferred embodiments of the present invention will be readily understood by the accompanying drawings and detailed descriptions, wherein.

DETAILED DESCRIPTION OF THE INVENTION

The present invention providing a clip-on earphone can be exemplified but not limited by the preferred embodiment as described hereinafter.

Figure 1:
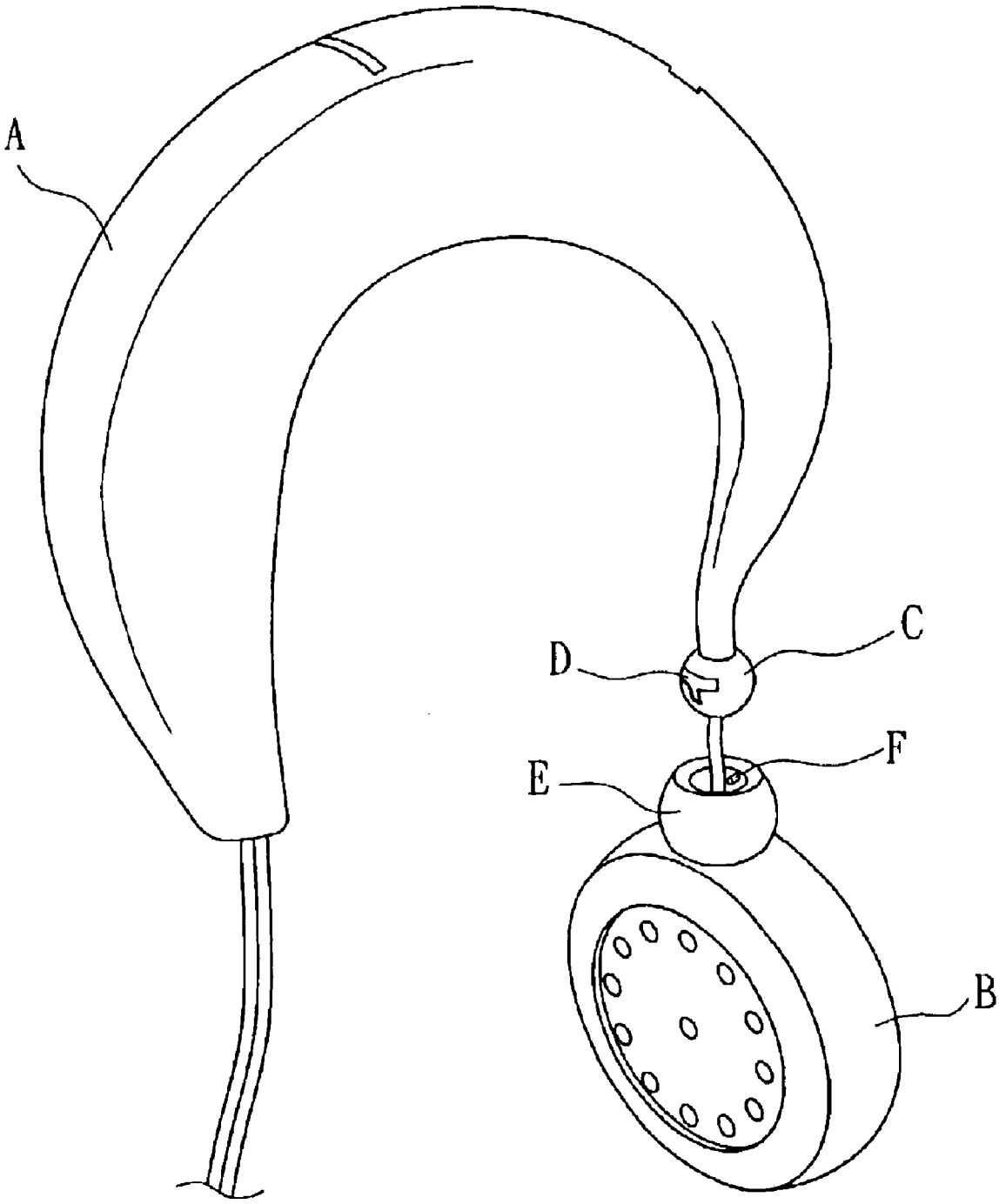
FIG. 1 (PRIOR ART)
FIG. 1 is a perspective view showing a clip-on earphone device according to the prior art.
Figure 2:
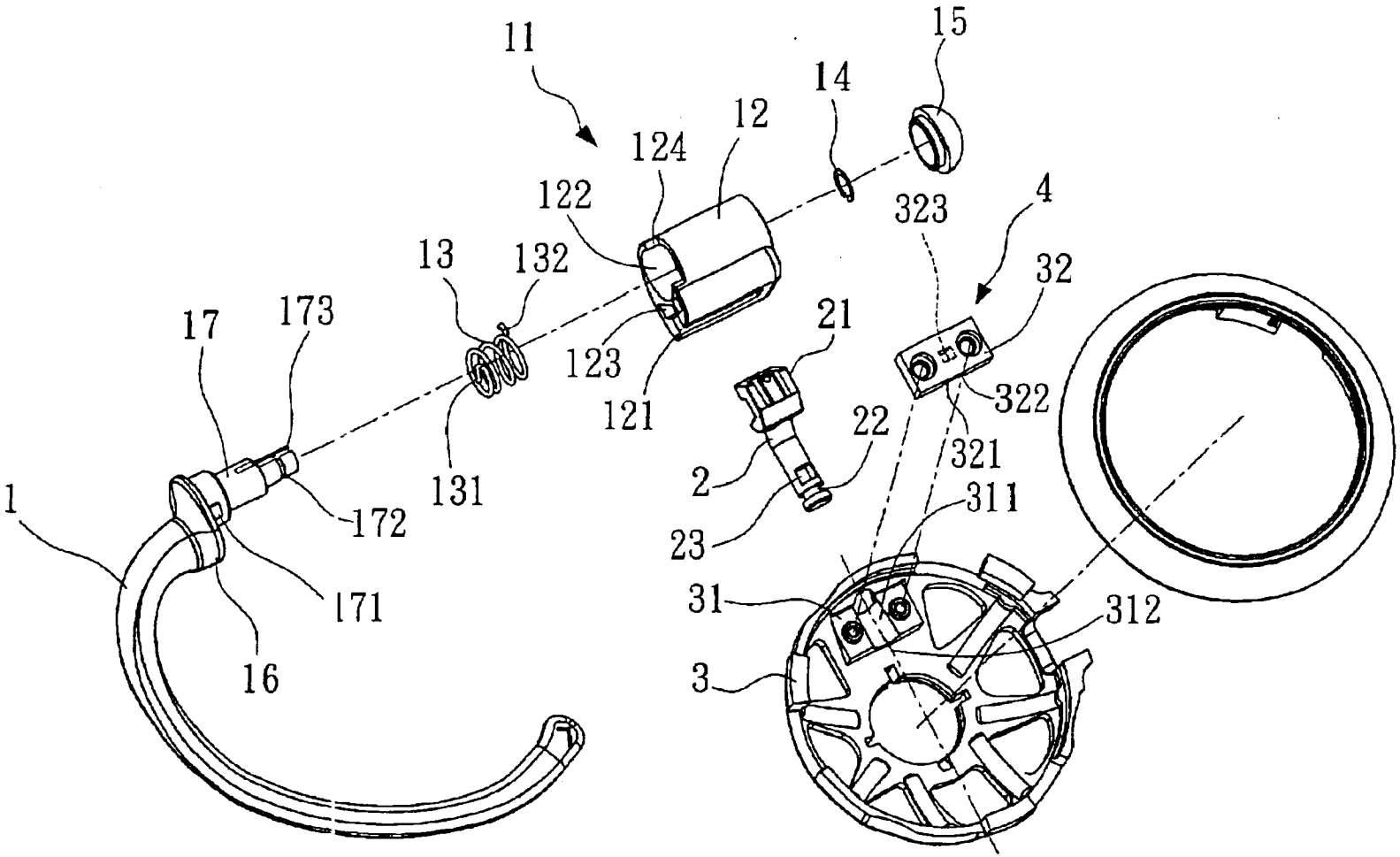
FIG. 2 is an exploded view showing a clip-on earphone device according to a preferred embodiment of the present invention.
Figure 3:
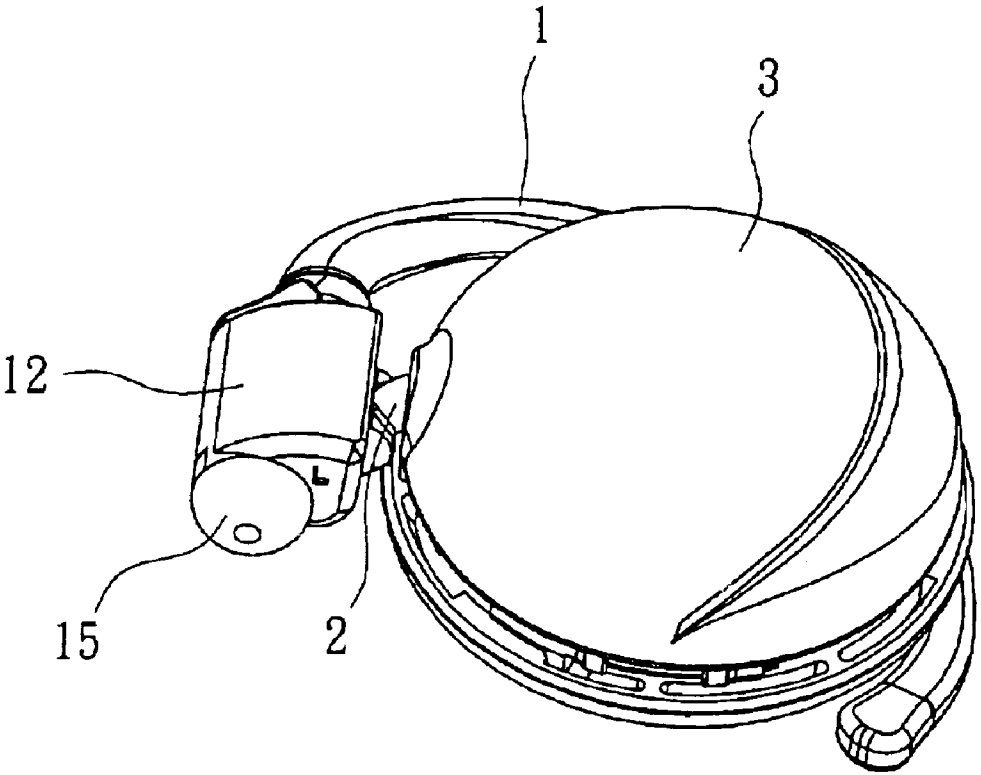
FIG. 3 is a perspective view showing the clip-on earphone device of FIG. 2.

Please refer to FIG. 2 and FIG. 3, which are an exploded view and a perspective view, respectively, showing a clip-on earphone device according to a preferred embodiment of the present invention. The clip-on earphone device comprises: a clip-on member 1; a connecting member 2; and an earphone 3. As shown in FIG. 2, a connecting base 12 having a door is coupled via a resilient repositioning mechanism 11 to the C-shaped clip-on member 1. A chute 121 is disposed on the connecting base 12. A sliding element 21 for connecting with the chute 121 is provided at one end of the connecting member 2. The other end of the connecting member 2 is attachable to the earphone 3 via a positioning mechanism 4.

Moreover, the resilient repositioning mechanism 11 comprises: a spring element 13, a fastening element 14 and a case 15. A flange 16 having an axis 17 is disposed on the clip-on member 1. An eminent portion 171 is formed near the flange 16 on the axis 17. A ring-shaped groove 172 is formed on the other end of the axis 17. At the tip of the axis 17, a trench 173 is provided. Therefore, a channel 122 having a trench 123 is formed such that the axis 17 can be inserted into the connecting base 12. Furthermore, a concave cut 124 is formed on the connecting base 12 facing the axis 17. Positioning portions 131 and 132 on both ends of the spring element 13 are bended inwards to the axis 17 and outwards, respectively, such that the spring element 13 is coupled to the axis 17. The positioning portion 131 is fitted with the trench 173, while the positioning portion 132 is fitted with the trench 123. The axis 17 and the ring-shaped groove 172 are exposed outside the connecting base 12. The fastening element 14 is attached to the ring-shaped groove 172 and the case 15 is attached to the axis 17 such that a clip-on earphone device is completed. Moreover, when the user rotates the connecting base 12 outwards, the eminent portion 171 and the concave cut 124 are used to limit the rotation angle of the connecting base 12; meanwhile the spring element 13 pushed the connecting base 12 back to an original position.

Accordingly, the opening end of the chute 121 and the flange 16 contact so as to prevent the connecting member 2 from falling from the opening end of the chute 121. Similarly, the user only has to rotate the connecting base 12 for a certain angle such that the flange does not block the opening of the chute 121. Therefore, the connecting member 2 is easily detached from the connecting base 12.

The connecting member 2 is connected to the earphone 3 via the positioning mechanism 4. A ring-shaped groove 22 is provided at the bottom of the connecting member 2 such that the earphone 3 rotates in a limited angle range. However, a base 31 and a fixing member 32 corresponding to the ring-shaped groove 22 are provided in the earphone 3, in which the fixing member 32 is solidly attached to the base 31. A concave surface 311 is formed on the base 31 and a concave surface 321 is formed on the fixing member 32, such that a compartment is formed by the concave surfaces 311 and 321. Moreover, on the concave surfaces 311 and 321, there are provided flanges 312 and 322, respectively, such that the flanges 312 and 322 can be clipped onto the ring-shaped groove 22. A trench 23 is formed on the connecting member 2. An eminent portion 323 corresponding to the trench 23 is formed on the fixing member 32 so as to limit the angle range in which the earphone 3 rotates.

Figure 4:
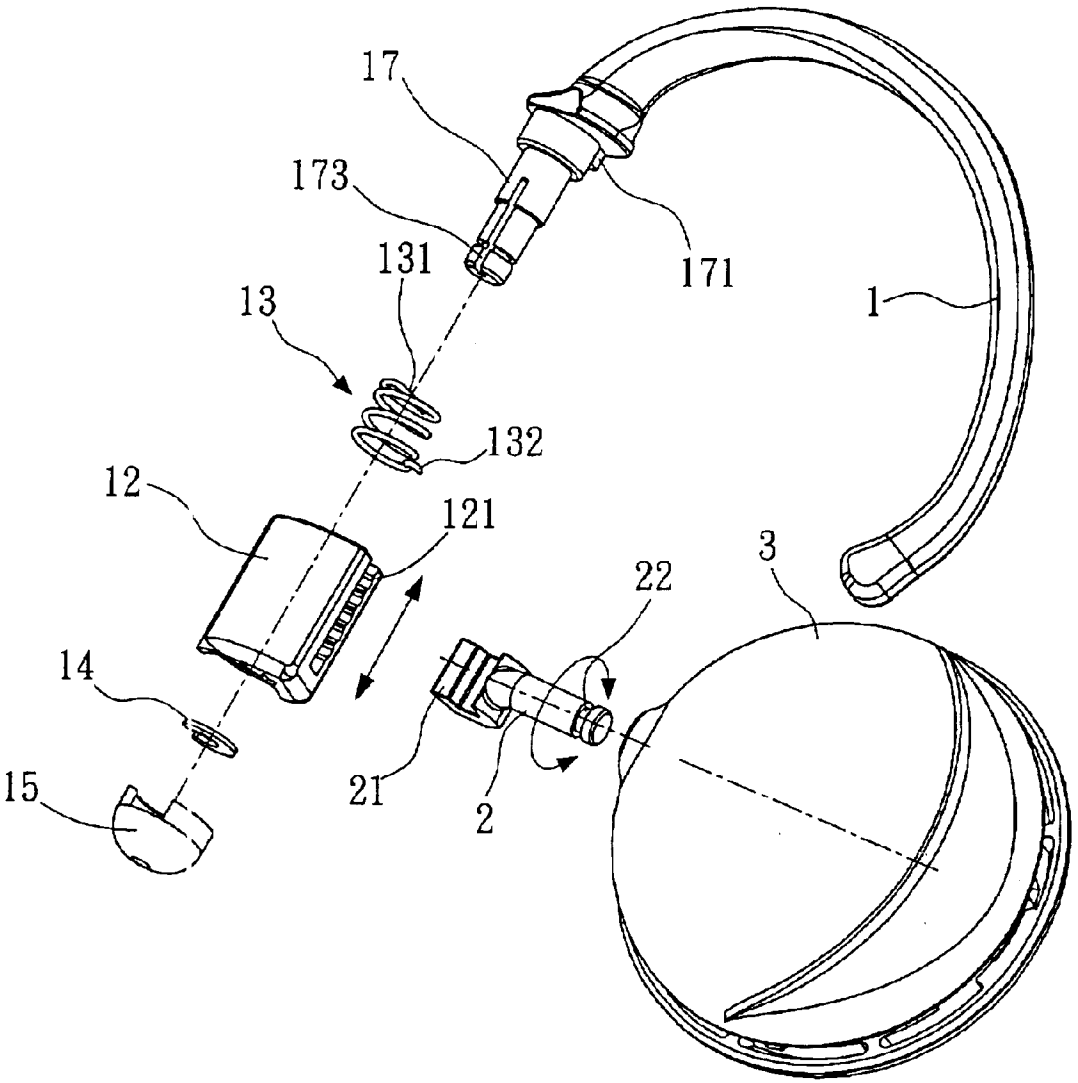
FIG. 4 is a schematic diagram showing the adjustment of the clip-on earphone device of FIG. 2.

According to the present invention, the clip-on earphone device is advantageous in that the position of the earphone can be adjusted and the earphone can rotate within a limited angle range in accordance with the face profiles of the users, as shown in FIG. 4.

Figure 5:
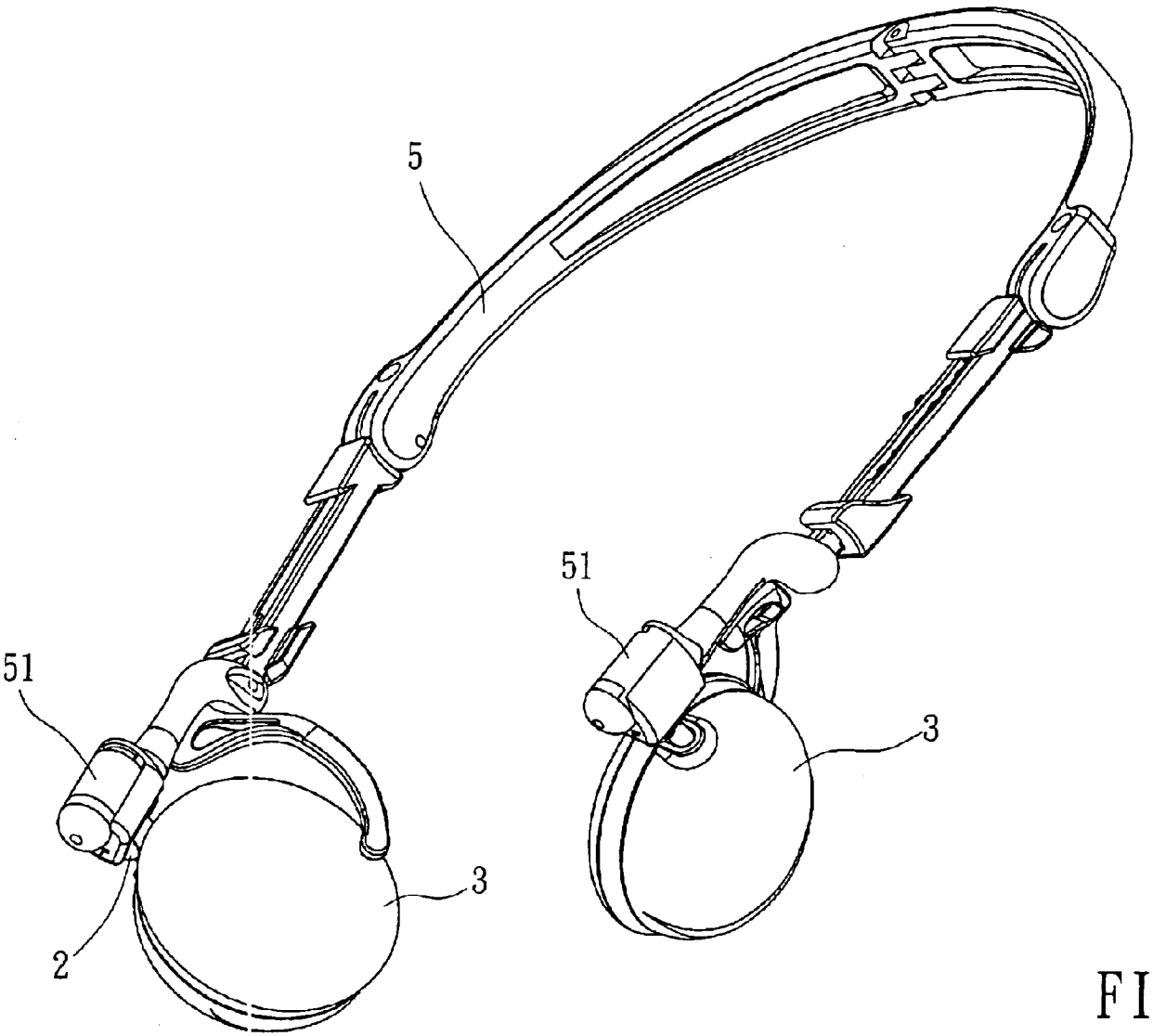
FIG. 5 is a perspective view showing a headphone device according to another preferred embodiment of the present invention.

Furthermore, the connecting member 2 and the earphone 3 can be attached to a headphone framework 5 via a connecting member 51, thus forming a headphone, as shown in FIG. 5.

Figure 6:
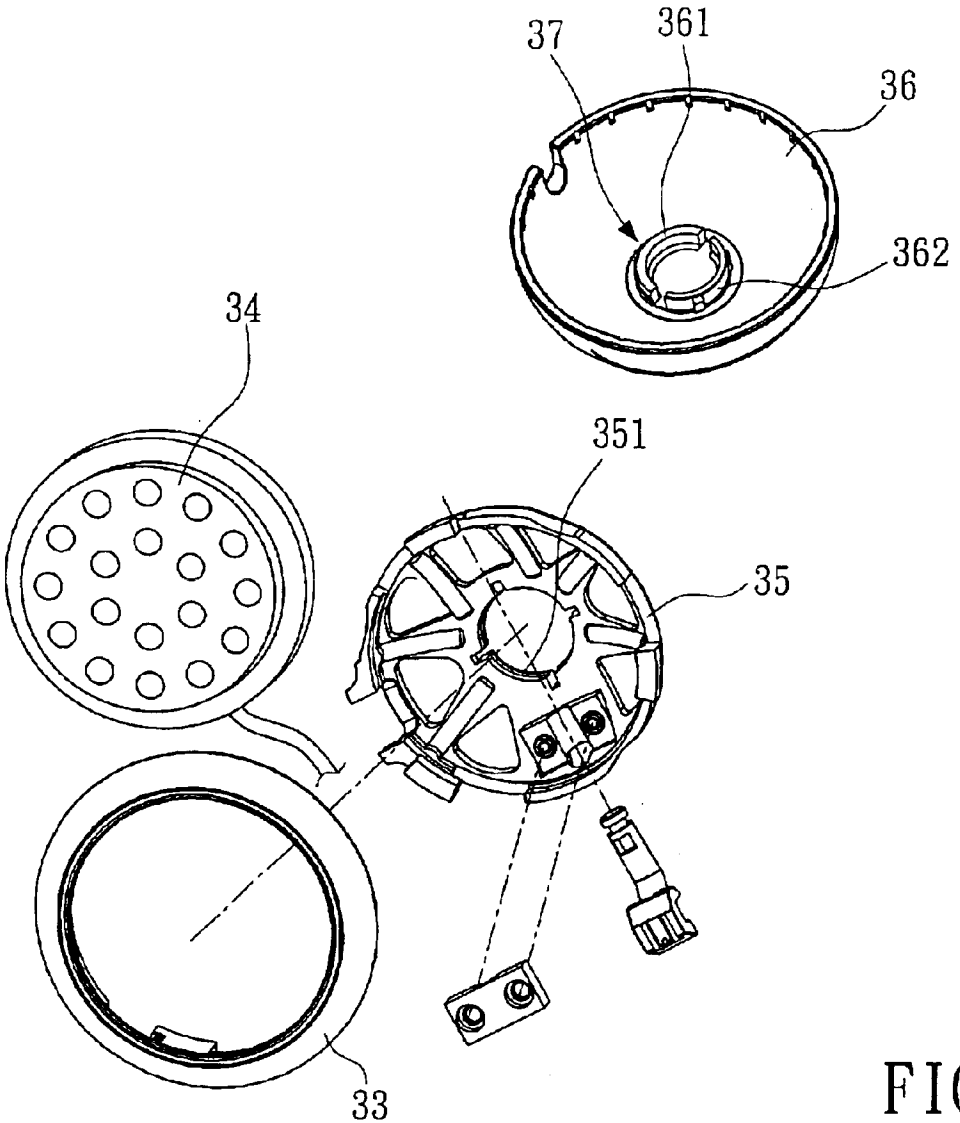
FIG. 6 is an exploded view showing an earphone of the present invention.

Moreover, please refer to FIG. 6, which is an exploded view showing an earphone of the present invention. In FIG. 6, the earphone comprises a base 33, a driver 34, a body 35 and a cap 36. The base 33 and the body 35 can be combined to form a compartment so as to accommodate the driver 34. A ring-shaped groove 351 is formed on the body 35. Furthermore, the cap 36 can be fixedly attached to the body 35 or be flexibly attached to the body 35 by using a buckle member 37 such that the case 36 is removable and changeable.

More particularly, the buckle member 37, as shown in FIG. 6., comprises: a ring-shaped clip 361 having a flange 362. The ring-shaped clip 361 corresponds to the ring-shaped groove 351 such that the cap 36 can be attached to the body 35.

According to the above discussion, the present invention discloses a clip-on earphone device, in which the position of the earphone can be adjusted and the earphone can rotate within a limited angle range in accordance with the face profiles of the users. Therefore, the present invention has been examined to be novel, unobvious and useful.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. An earphone device, comprising:

a clip-on member coupled to a connecting base via a resilient repositioning mechanism, wherein a chute is disposed at the bottom of said connecting base;

a connecting member having a sliding element coupled to said chute such that said sliding element slides in said chute; and an earphone coupled to said connecting member via a positioning mechanism such that said earphone rotates in an angle range, wherein said clip-on member comprises:

a flange disposed on one end of said clip-on member;

an axis disposed on said flange;

an eminent portion formed near said flange on said axis;

a ring-shaped groove formed on the other end of said axis; and a trench provided on the tip of said axis;

wherein a channel having a trench is formed such that said axis is inserted into said connecting base and a concave cut is formed on said connecting base facing said axis.

2. The earphone device as recited in claim 1, wherein said resilient repositioning mechanism comprises:

a spring element having positioning portions on both ends of said spring element being bended inwards to said axis and outwards, respectively;

a fastening element, element attached to the ring-shaped groove; and a case attached to the axis;

wherein said spring element is coupled to said axis and said positioning portion bended inwards is fitted with said trench on said axis, while said positioning portion bended outwards is fitted with said trench on said connecting base; and wherein said axis and said ring-shaped groove are exposed outside the connecting base.

3. The earphone device as recited in claim 1, wherein said resilient repositioning mechanism comprises:

a ring-shaped groove formed at the bottom of said connecting member;

a repositioning base and a fixing member corresponding to said ring-shaped groove, in which said fixing member is solidly attached to said repositioning base;

a concave surface formed on said repositioning base; and a concave surface is formed on said fixing member, such that a compartment is formed by said concave surfaces; and wherein there are provided flanges, such that said flanges are clipped onto the ring-shaped groove.

4. The earphone device as recited in claim 3 wherein an eminent portion corresponding to said trench on said connecting member is formed on said fixing member so as to limit the angle range in which said earphone rotates.

5. The earphone device as recited in claim 4, wherein said fixing member is solidly attached to said repositioning base by using one method selected from a group of a buckle, a screw and agglutination.

6. The earphone device as recited in claim 1, wherein said earphone comprises:

an earphone base;

a driver;

a body, said earphone base and said body being combined to form a compartment so as to accommodate said driver; and a cap attached to said body;

wherein a ring-shaped groove is formed on said body.

7. The earphone device as recited in claim 6, wherein said cap is solidly attached to said body by agglutination.

8. The earphone device as recited in claim 6, wherein said cap is flexibly attached to said body by using buckle member such said case is removable and changeable.

9. The earphone device as recited in claim 8 wherein said buckle member comprises:

at least one ring-shaped clip having a flange corresponding to said ring-shaped groove such that said cap is attached to said body.

* * * * *